US009161116B2

(12) United States Patent
Ishizaki

(10) Patent No.: US 9,161,116 B2
(45) Date of Patent: Oct. 13, 2015

(54) HEADPHONE APPARATUS

(71) Applicant: Sony Corporation, Tokyo (JP)

(72) Inventor: Nobuyuki Ishizaki, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/362,825

(22) PCT Filed: Oct. 22, 2012

(86) PCT No.: PCT/JP2012/077814
§ 371 (c)(1),
(2) Date: Jun. 4, 2014

(87) PCT Pub. No.: WO2013/099417
PCT Pub. Date: Jul. 4, 2013

(65) Prior Publication Data

US 2014/0348371 A1 Nov. 27, 2014

(30) Foreign Application Priority Data

Dec. 29, 2011 (JP) ..... 2011-290208

(51) Int. Cl.
*H04R 1/10* (2006.01)
*H04R 5/033* (2006.01)

(52) U.S. Cl.
CPC ..... *H04R 1/105* (2013.01); *H04R 5/0335* (2013.01)

(58) Field of Classification Search
CPC .... H04R 1/10; H04R 2205/022; H04R 1/105; H04R 5/0335; H04R 2201/10
USPC ..... 381/370–371, 374, 377–379, 383
See application file for complete search history.

(56) References Cited

U.S. PATENT DOCUMENTS

| | | | | |
|---|---|---|---|---|
| 4,993,065 A * | 2/1991 | Chiou | 381/375 |
| 5,185,807 A * | 2/1993 | Bergin et al. | 381/378 |
| 6,081,604 A * | 6/2000 | Hikichi et al. | 381/378 |
| 6,295,366 B1 * | 9/2001 | Haller et al. | 381/374 |
| 8,488,814 B2 * | 7/2013 | Robuchon et al. | 381/378 |

FOREIGN PATENT DOCUMENTS

| | | |
|---|---|---|
| JP | 2005-269075 A | 9/2005 |
| JP | 2005-311630 A | 11/2005 |
| JP | 2008-205585 A | 9/2008 |
| JP | 2011-087047 A | 4/2011 |

OTHER PUBLICATIONS

International Search Report: International Application No. PCT/JP2012/077814; Filed: Oct. 22,2012; Completion of the international search: Jan. 11, 2013. (Form PCT/ISA/210).

* cited by examiner

*Primary Examiner* — Suhan Ni
(74) *Attorney, Agent, or Firm* — Michael Best & Friedrich LLP

(57) ABSTRACT

A headphone includes a pair of acoustic reproduction units, a supporting member connecting the pair of acoustic reproduction units, and a soft member configured to be rotatable relative to the supporting member and arranged on the side opposite to the head of a person wearing the headphone.

6 Claims, 6 Drawing Sheets

A

B

A

B

A

B

A

B

A

B

HEADPHONE APPARATUS

TECHNICAL FIELD

The present disclosure relates to a headphone apparatus. In particular, the present disclosure relates to a headphone apparatus capable of reducing uncomfortable feelings while improving stableness in wearing the headphone apparatus.

BACKGROUND ART

With the progress of digital electronic devices and the Internet technology, users of the digital electronic devices have come to easily enjoy various types of content including musical content and video content recorded on optical discs or distributed via the Internet. For example, a user of a portable electronic device can enjoy various types of content even in the outdoors.

With improved convenience of content by digital electronic devices, etc., there is an increased demand of users who want to enjoy content at a better sound quality.

In general, a headphone is used to view or listen to the content outdoors. A headphone may also be used even in an indoor environment to seek for a better sound quality during indoor viewing and listening of the content. Therefore, there is a very high demand for improving audio quality for the headphone.

To improve the sound quality of musical content to be reproduced by the headphone, the size of an electro-acoustic conversion unit of the headphone would be bigger, leading to an increased weight of the headphone units including right and left parts corresponding to both ears.

Generally, a set of the headphone units are supported by a pad being in contact with the head of a user. The pad is provided on a head band connecting the headphone units. There is a case, however, where the headphone may cause uncomfortable feelings to the user wearing the headphone due to an insufficient support of the set of the headphone units.

To improve stableness in wearing the headphone, Patent Document 1 below discloses, for example, two head bands and a head cushion arranged between the head bands, with the head cushion being in contact with the head of a person.

CITATION LIST

Patent Document

Patent Document 1: Japanese Patent Application Laid-Open No. 2005-311630

SUMMARY OF THE INVENTION

Problems to be Solved by the Invention

It is desired to improve stableness in wearing a headphone.

Solution to Problems

According to a preferred embodiment of the present disclosure, a headphone apparatus includes a pair of acoustic reproduction units, a supporting member connecting the pair of acoustic reproduction units, and a lower cushion material 31, also known as a soft member 31, configured to be rotatable relative to the supporting member and arranged on the side opposite to the head of a person wearing the headphone apparatus.

In the present disclosure, the soft member arranged on the side opposite to the head of the person wearing the headphone apparatus is configured to be rotatable relative to the supporting member connecting the pair of the acoustic reproduction units. Therefore, the arrangement of the soft member follows tilting of the top of the head of the headphone user in the front-back direction. This prevents application of pressure locally on the head of the user, and the uncomfortable feelings of the user wearing the headphone apparatus can be decreased. In addition, the weight of the headphone apparatus is equally distributed over the top of the head of the user to thereby improve stableness in wearing the headphone apparatus.

Effects of the Invention

According to at least one embodiment of the present disclosure, it is possible to improve stableness in wearing a headphone apparatus.

MODE FOR CARRYING OUT THE INVENTION

Embodiments of a headphone will be described below. Description will be given in the following order.

<1. One Embodiment>

[1-1. Schematic Structure of Headphone Apparatus]

(1-1-1. Headphone Unit)

(1-1-2. Head Band)

[1-2. First Modified Example]

(1-2-1. Supporting Plate)

[1-3. Second Modified Example]

(1-3-1. Low Friction Material)

<2. Modified Example>

Embodiments described below are specific and preferable examples of the headphone apparatus. In the description below, technically preferable various limitations have been provided; however, the examples of the headphone apparatus will not be limited to the embodiments described below unless otherwise specified to limit the scope of the present disclosure.

1. One Embodiment

1-1. Schematic Structure of Headphone

Figure 1:
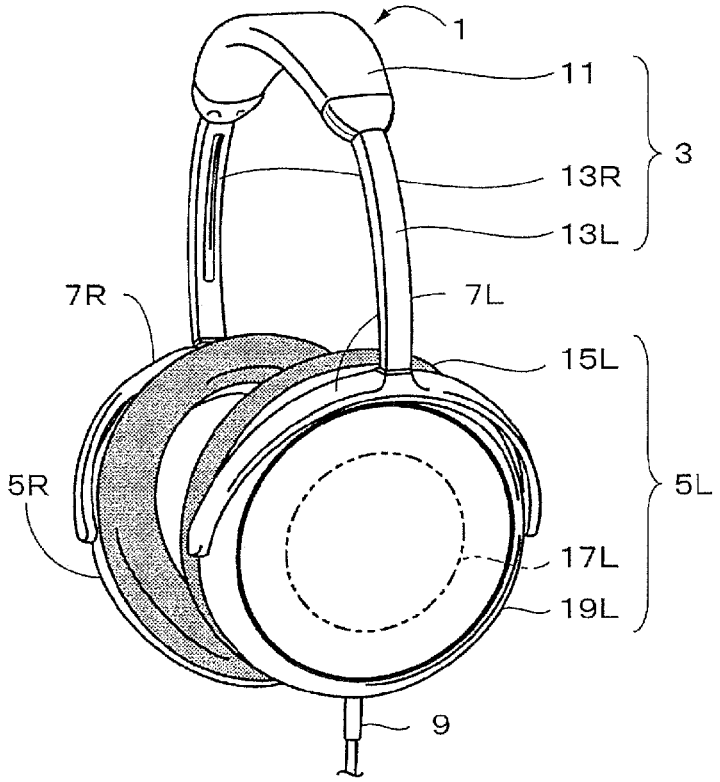
FIG. 1A is a perspective view illustrating a headphone according to an embodiment of the present disclosure.
FIG. 1B is a schematic view illustrating a user wearing the headphone apparatus according to the embodiment of the present disclosure.
Figure 1:
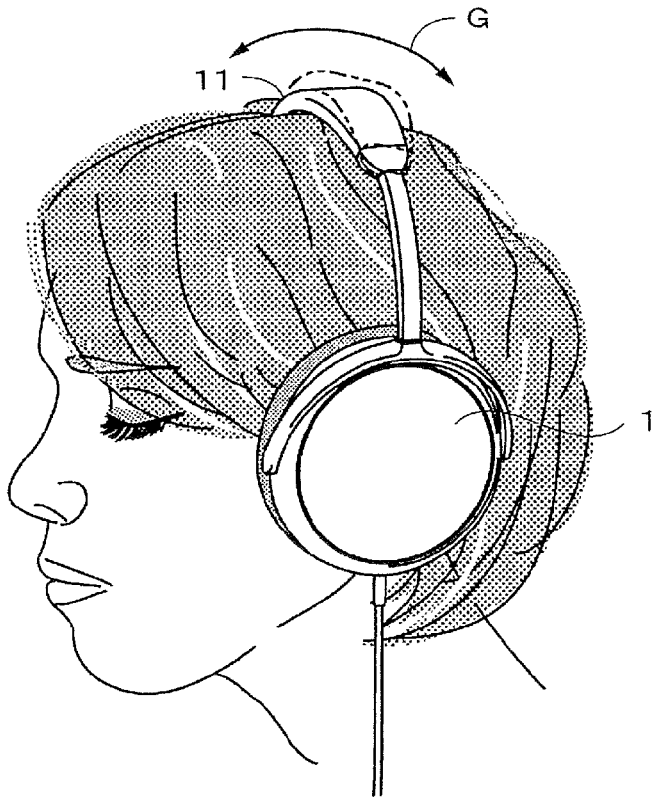

FIG. 1A is a perspective view illustrating a headphone apparatus according to an embodiment of the present disclosure. FIG. 1B is a schematic view illustrating a user wearing the headphone apparatus according to the embodiment of the present disclosure.

As illustrated in FIG. 1A, a headphone apparatus 1 includes, for example, a head band 3, also known as a supporting member 3, headphone units 5L and 5R, also known as a pair of acoustic reproduction units 5L and 5R, and hangers 7L and 7R. The headband 3 includes a pad portion 21 and slider portions 13R and 13L connected at respective end portions of the pad portion 21. The pad portion 21 includes a lower cushion material 31, also known as a soft member 31. A core material 33 in a form of a band extends through and across the pad portion 21 to the slider portions 13R and 13L and interacts with the lower cushion material 31, also known as the soft member 31. Hangers 7R and 7L interconnect respective ends of the slider portions 13R and 13L and respective ones of the headphone units 5L and 5R, also known as a pair of acoustic reproduction units 5L and 5R.

As illustrated in FIG. 1B, the headphone units 5L and 5R are located on the right and left, respectively, corresponding to right and left ears of the user wearing the headphone apparatus 1. As mentioned above, the headphone units 5L and 5R are connected by the head band 3, for example, via the hangers 7L and 7R, respectively.

The head band 3 is shaped in an arc to generally protrude upward in a vertical direction in order to fit the shape of the head of the user. A pad 11 is arranged substantially in the center of the head band 3.

As described in more detail below, the pad 11 includes a cushion material. Since the pad 11 includes the cushion material and is in contact with the head of the user, the weight of the headphone apparatus 1 is transmitted to the head of the user via the cushion material.

Also, the pad 11 is configured to be rotatable relative to the core material 33 placed inside the head band 3, as will be described in more detail below. Accordingly, the pad 11 rotates to follow the tilting of the top of the head of the user wearing the headphone apparatus 1, as illustrated in FIG. 1B. That is, the pad 11 may be configured to be rotatable, for example, along a direction indicated by an arrow G of FIG. 1B.

The headphone units 5L and 5R and the head band 3 will be described below in this order. The headphone apparatus 1 has a substantially symmetrical configuration in a horizontal direction. For example, the headphone unit 5L located on the left of the user and the headphone unit 5R located on the right of the user have mostly similar configurations. Therefore, with regard to the constituent elements, such as the members to be arranged symmetrically on the right and left of the user, only left side elements of the user will be described below (1-1-1. Headphone Unit)

The headphone unit 5L generally includes a speaker unit 17L used for electro-acoustic conversion, a housing 19L storing the speaker unit 17L, and an ear pad 15L.

A voice signal used for electro-acoustic conversion is sent from an acoustic reproduction apparatus via a cord 9 connected to the acoustic reproduction apparatus and a connector portion provided in one of the two headphone units 5L and 5R. In FIGS. 1A and 1B, an exemplary structure where the cord 9 is connected to the connector portion formed in the headphone unit 5L is illustrated.

A voice signal having been sent to one of the two headphone units is sent to the other headphone unit, for example, via a transmission line placed inside the head band 3. Transmission of the voice signal between the right and left headphone units, or between the headphone unit and the acoustic reproduction apparatus is not limited to a wired system. Instead, the transmission of voice signals may, of course, be carried out by a wireless system.

The speaker units receive a voice signal and execute electro-acoustic conversion corresponding to the received voice signal. Sound is reproduced from the respective speaker units to reach ears of the user. Thus, the user recognizes the reproduced sound from the speaker units.

An ear pad 15L has a cushion characteristic and is arranged circumferentially at a portion where the headphone unit 5L is in contact with an area surrounding the ear of the user.

The ear pad 15L is provided to alleviate the feeling of pressure on the user around the ear caused by the contact with the headphone unit 5L. Since the head band 3 is generally shaped in an arc, a side pressure is applied to the user wearing the headphone through the right and left headphone units. In a sound-isolating type headphone, the ear pad 15L serves to form a closed space around the ear of the user.

(1-1-2. Head Band)

The head band 3 is formed, for example, by the slider portions 13L and 13R, and the pad 11.

The slider portion 13L is formed, for example, by a plurality of members to allow expansion and contraction along the extending direction of the slider portion 13L. Thus, the user can adjust positions of the right and left headphone units according to the shape and size of the head of the user.

A hanger 7L, for example, is arranged between the slider portion 13L and the headphone unit 5L. A hanger 7R, for example, is arranged between the slider portion 13R and the headphone unit 5R.

The hanger 7L is formed in an arc, for example, and the center part of the arc is coupled with the slider portion 13L, while both ends of the arc is coupled with the headphone unit 5L. Thus, the headphone unit 5L is supported by the head band 3.

The hanger 7L is, for example, coupled with the slider portion 13L in a rotatable manner, with a rotation axis being in a direction in which the slider portion 13L extends. The headphone unit 5L may, for example, be rotatably connected with the hanger 7L by regarding an axis connecting both ends of the arc-shaped hanger 7L as a rotation axis. Thus, the headphone unit 5L is supported on the head band 3, so as to follow the side of the face of the user.

Figure 2:
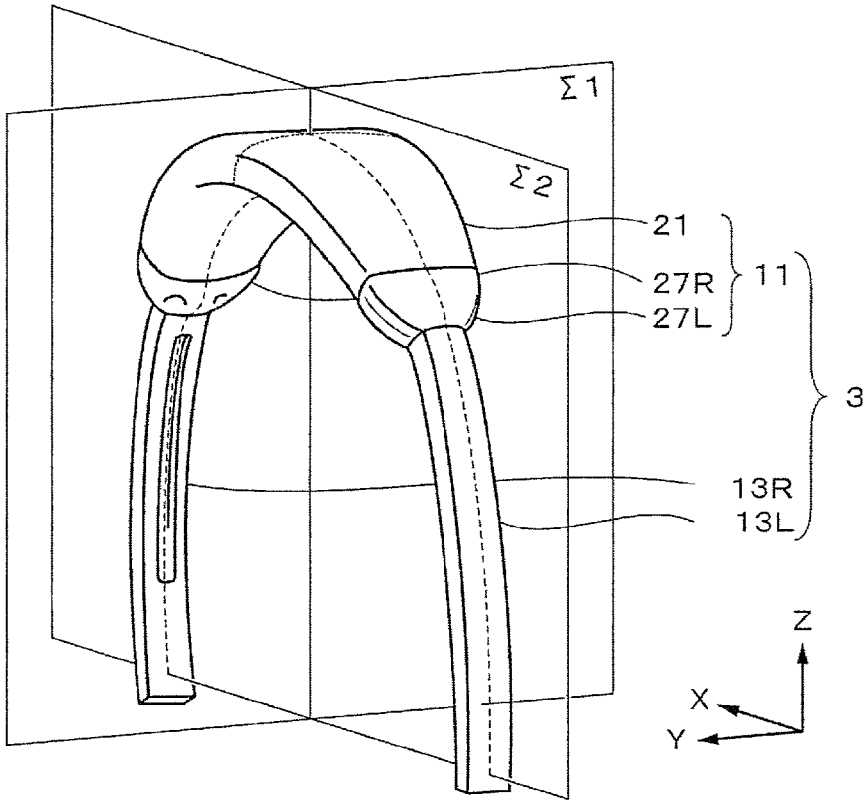
FIG. 2A is a perspective view illustrating a head band of the headphone apparatus according to the embodiment of the present disclosure.
FIG. 2B is a schematic view illustrating an example of a cross-section of a pad portion when cut along a plane perpendicular to a direction connecting right and left headphone units.
Figure 2:
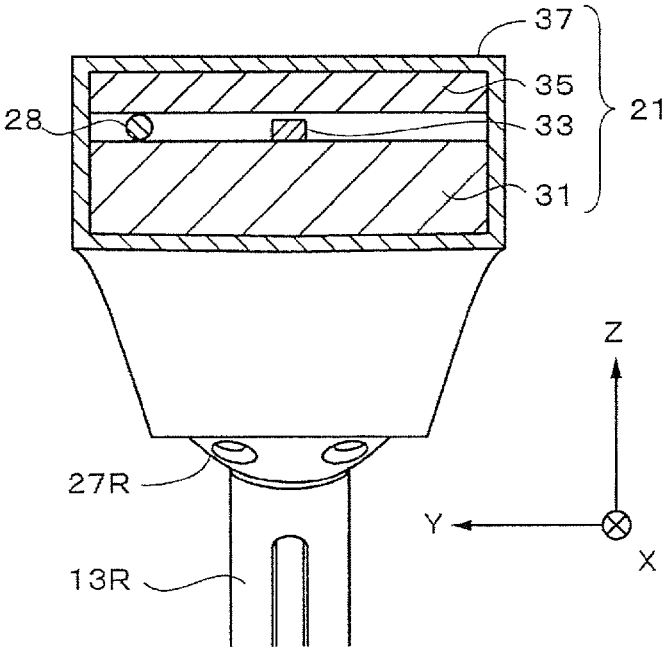

FIG. 2A is a perspective view illustrating a head band of the headphone apparatus 1 according to the embodiment of the present disclosure. In the following description, a direction traveling from the left side toward the right side of the user wearing the headphone apparatus 1 is regarded as an X direction. Also, a direction toward the front of the user is regarded as a Y direction, and a direction going upward of the user is regarded as a Z direction. At this time, as illustrated in FIG. 2A, a plane provided in parallel with a YZ plane and passing through the center of the pad 11 is regarded as Σ1, and a plane provided in parallel with a ZX plane and passing through the center of the head band 3 is regarded as Σ2. Specifically, Σ1 is vertical to a direction connecting the right and left headphone units. Σ2 is a plane including a direction connecting the right and left headphone units and a vertical direction.

The pad 11 includes, for example, the pad portion 21 and end covers 27L and 27R, as illustrated in FIG. 2A. The pad 11 is located above the head of the user when the headphone apparatus 1 is worn such that the pad portion 21 located in the center of the pad 11 touches the head of the user.

As described below, the pad portion 21 includes, for example, the lower cushion material 31, the core material 33, an upper cushion material 35, and a covering material 37.

Figure 3:
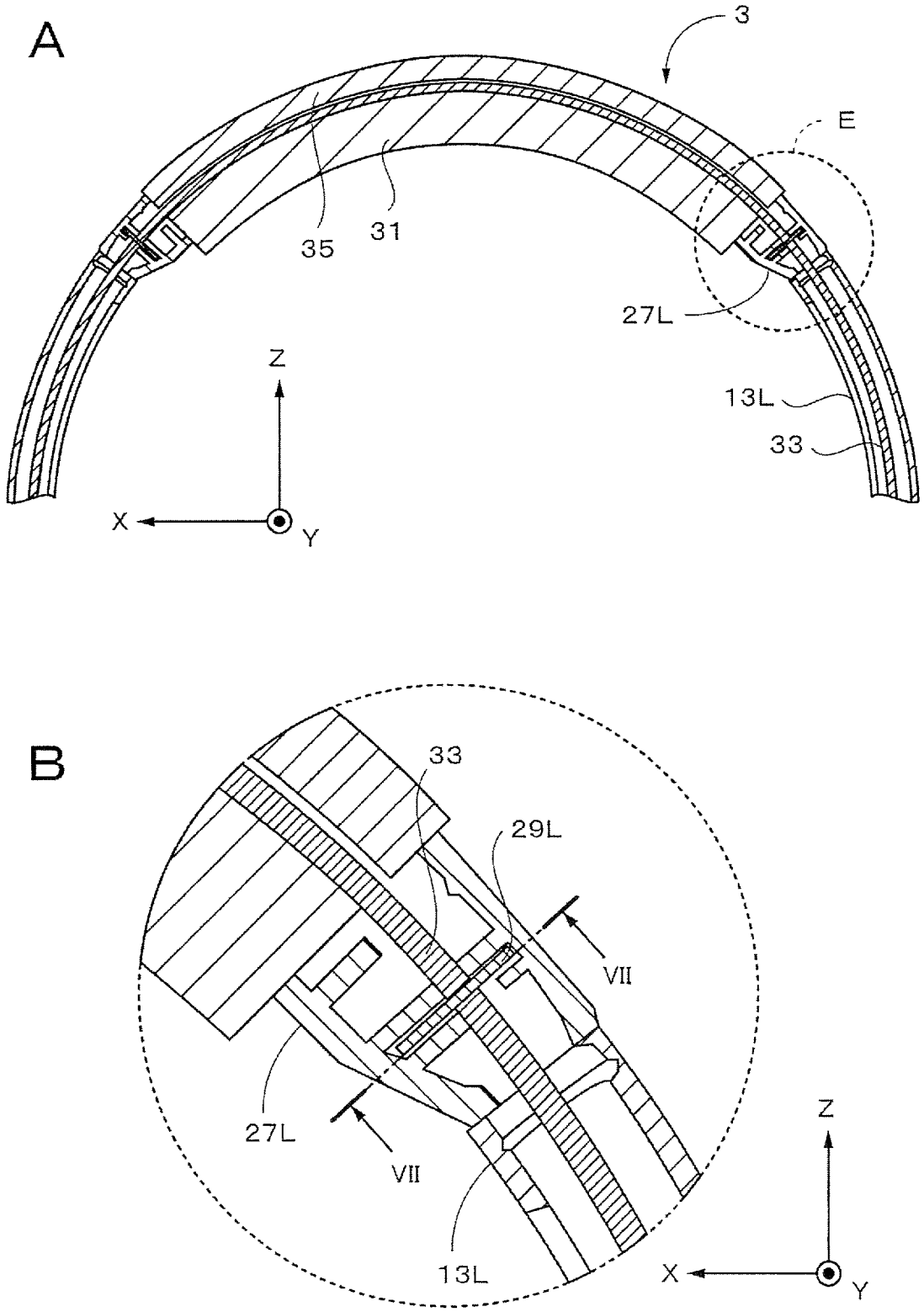
FIG. 3A is a schematic view illustrating an example of a cross-section of the head band when cut along a plane in a direction connecting the right and left headphone units and along a vertical plane.
FIG. 3B is an enlarged view of a part E of FIG. 3A, surrounded by a broken line.

FIG. 2B is a schematic view illustrating an example of a cross-section of the pad portion when cut along a plane (Σ1 illustrated in FIG. 2A) vertical to a direction connecting the right and left headphone units. FIG. 3A is a schematic view illustrating an example of a cross-section of the head band when cut along a plane (Σ2 illustrated in FIG. 2A) in a direction connecting the right and left headphone units and also including a vertical direction. FIG. 3B is an enlarged view of a part E of FIG. 3A, surrounded by a broken line. In FIGS. 3A and 3B, the covering material 37 is not shown.

As illustrated in FIG. 2B, the inside of the pad portion 21 is a stacked structure including, for example, the lower cushion material 31, the core material 33, and the upper cushion material 35 stacked on top of each other. A stacked body including the lower cushion material 31, the core material 33, and the upper cushion material 35 is covered with the covering material 37.

Both ends of the covering material 37 are fixed by, for example, the end covers 27L and 27R. Therefore, the pad 11 of the head band 3 is formed integrally by the stacked body including the lower cushion material 31, the core material 33, and the upper cushion material 35, the covering material 37, and the end covers 27L and 27R.

In the present disclosure, the core material 33 is not fixed with a surface that has been in contact with the lower cushion material 31. That is, the pad 11 is, for example, fixed to the core material 33 with a freedom of rotation relative to the core material 33, by the end covers 27L and 27R arranged on both ends of the pad 11. Thus, the lower cushion material 31 is formed rotatably relative to the core material 33.

The lower cushion material 31 is a cushion material arranged on the opposite side of the head of the user when the headphone apparatus 1 is worn. As illustrated in FIG. 3A, the lower cushion material 31 is generally shaped like an arc with a predetermined width to fit the shape of the top of the head of the user. The lower cushion material 31 is held by, for example, the covering material 37 in a rotatable manner relative to the core material 33 which is described below, so as to follow a slant of the top of the head of the user.

Preferably, the lower cushion material 31 is formed by a material having a suitable cushioning property, such as urethane resin (polyurethane), rubber, silicone, and felt. The lower cushion material 31 may have a sponge-like porous structure.

The core material 33 provides a proper strength to the head band 3 to keep the arc-like shape of the head band 3, while supporting the weight of the laterally held headphone units 5L and 5R.

As illustrated in FIGS. 2B and 3A, the core material 33 is arranged between the lower and upper cushion materials 31 and 35. The core material 33 is generally shaped like an arc, and both ends of the core material 33 are extended to the positions of the hangers 7L and 7R. A transmission line 28 connecting the right and left headphone units is, as illustrated in FIG. 2B, arranged between the upper and lower cushion materials 35 and 31 along the core material 33.

The core material 33 is formed by a substantially reverse U-shaped plate material having a spring characteristic. The core material 33 is required to have a spring characteristic because a lateral pressure has to be applied to the headphone units attached on both sides of the core material 33 when the headphone is worn on the head, to thereby push and support the head by the headphone units. The core material 33 is made of, for example, a metal such as stainless steel (SUS) or iron, a carbon composite material such as a carbon fiber reinforced plastic, or a crystalline resin such as polyoxymethylene (POM) (also referred to as a polyacetal resin), polypropylene (PP), or polybutylene terephthalate (PBT).

In view of making the pad 11 rotatable about the core material 33, as illustrated in FIG. 2B, an aspect ratio of a cross-section of the core material 33 is preferably closer to 1, when cut along a plane perpendicular to a direction connecting the right and left headphone units. Alternatively, it is preferable that a cross-section of the core material 33 be close to a circle when cut along a plane perpendicular to the direction connecting the right and left headphone units.

The upper cushion material 35 is a protecting member of the core material 33 and arranged opposite to the lower cushion material 31 relative to the core material 33. Similar to the lower cushion material 31, the upper cushion material 35 is generally shaped like an arc with a predetermined width to fit to the shape of the top of the head of the user.

A material of the upper cushion material 35 is not particularly limited, and may include a urethane resin and other resin materials, a metal, etc.

As illustrated in FIG. 2B, the pad portion 21 is formed, for example, by a stacked body including the lower cushion material 31, the core material 33, and the upper cushion material 35, with the stacked body being covered with the covering material 37. At this time, the space between the lower and upper cushion materials 31 and 35 may include only the core material 33 and the transmission line 28. Alternatively, the space between the lower and upper cushion materials 31 and 35 may of course be filled with a urethane resin, etc.

The covering material 37 is a tubular-shaped covering material made of, for example, a textile material such as polyester fiber, leather, or synthetic leather. The covering material 37 is formed to have a proper tensile strength in order to exert a force to the lower and upper cushion materials 31 and 35 in directions toward each other. By exerting a force to the lower and upper cushion materials 31 and 35 in directions toward each other, it is possible to hold the shape of the stacked body including the lower and upper cushion materials 31 and 35, and the core material 33.

Both ends of the tubular-shaped covering material 37 are fixed by, for example, the end covers 27L and 27R. The end covers 27L and 27R are each formed by, for example, an upper cover body and a lower cover body in such a manner that one end of the tubular covering material 37 is sandwiched between the upper and lower cover bodies.

Figure 4:
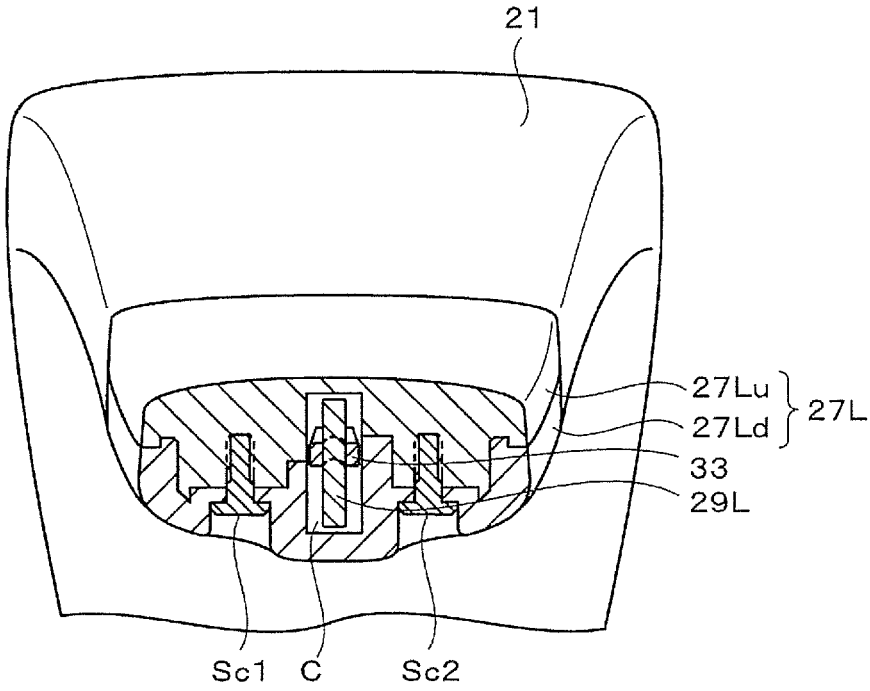
FIGS. 4A and 4B are schematic views illustrating cross-sections of an end cover.
Figure 4:
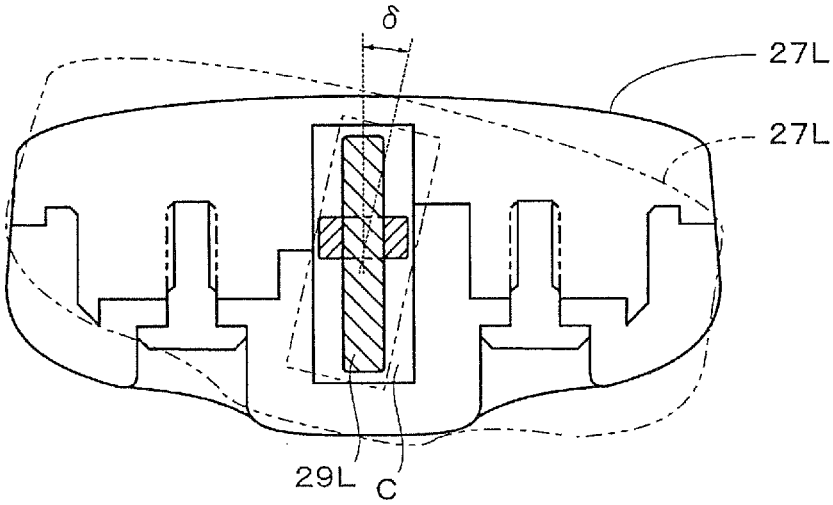

FIGS. 4A and 4B are schematic views illustrating cross-sections of the end cover. FIGS. 4A and 4B schematically illustrate cross-sections of the end cover 27L when cut in parallel with a plane perpendicular to the extending direction of the core material 33. FIGS. 4A and 4B correspond to the cross-sectional view when cut along line VII-VII in FIG. 3B.

In the exemplary structure illustrated in FIGS. 4A and 4B, the end cover 27L is formed by upper and lower cover bodies 27Lu and 27Ld made of a material such as a resin material. The upper and lower cover bodies 27Lu and 27Ld are joined together by screws Sc1 and Sc2. The upper and lower cover bodies 27Lu and 27Ld may of course be joined together by an adhesive or by welding.

As illustrated in FIG. 4A, the core material 33 is arranged to penetrate through a space C formed in substantially a center of a cross-section of the end cover 27L. The core material 33 and the end cover 27L are not fixed with each other, and the end cover 27L is rotatable relative to the core material 33.

Preferably, a rotatable angle of the end cover 27L relative to the core material 33 is included within a previously determined fixed range. That is, it is preferable to set the range of rotatable angle of the lower cushion material 31 (or may also be referred to as the pad 11) relative to the core material 33 to be within a previously determined fixed range. This is because the pad portion 21 may receive an excessive force to cause deformation and breakage of the pad portion 21 without any restrictions of the rotatable angle of the pad 11 relative to the core material 33.

For example, in the structural example illustrated in FIG. 4A, the space C having a rectangular cross-section, for example, is formed in substantially the center of the cross-section of the end cover 27L. The rectangular shape is formed by portions of the upper and lower cover bodies 27Lu and 27Ld. The core material 33 is arranged to penetrate through the space C. At the same time, the core material 33 is provided with a pin 29L that extends in a direction perpendicular to a width direction (Y-direction) of the pad portion 21 and to the extending direction of the pad portion 21. Similarly, the core material 33 is also provided with a pin at a position corresponding to the end cover 27R. Each pin may be configured to penetrate through the core material 33, or may be formed integrally with the core material 33.

By forming the space C by the portions of the upper and lower cover bodies 27Lu and 27Ld, and arranging the pin 29L in the core material 33, the pin 29L serves as a stopper to limit the rotation angle of the end cover 27L relative to the core material 33 within a fixed range. For example, in an example illustrated in FIG. 4B, the rotation angle of the end cover 27L relative to the core material 33 may be limited within twice the range of an angle 6 illustrated in FIG. 4B. That is, the rotation angle of the pad 11 relative to the core material 33 is limited within the fixed range to thereby prevent such a defect as breaking the covering material 37, etc. of the pad portion 21 by the core material 33.

In the structural examples of FIG. 3B and FIGS. 4A and 4B, the pin 29L is arranged in the core material 33. It may also be possible, however, to limit the rotation angle of the pad 11 relative to the core material 33 within the fixed range by providing a protruding portion in the space C formed in the end cover 27L. When the protruding portion is provided in the space C where the core material 33 penetrates through, the location of the protruding portion is not limited to both ends of the pad 11 (which are the portions where the end covers 27L and 27R are arranged). For example, the protruding portion may be set in the center of the pad portion 21 so as to limit the rotation angle of the pad 11 relative to the core material 33. Accordingly, the location of the protruding portion can be anywhere in the extending direction of the pad 11.

1-2. First Modified Example

Figure 5:
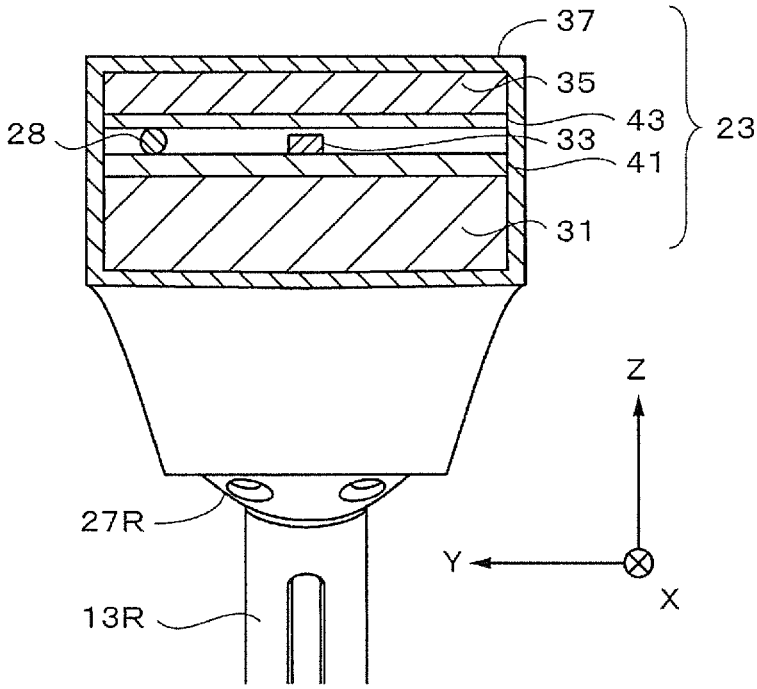
FIGS. 5A and 5B are cross-sectional views illustrating a first modified example of the pad portion of the headphone apparatus of the present disclosure.
Figure 5:
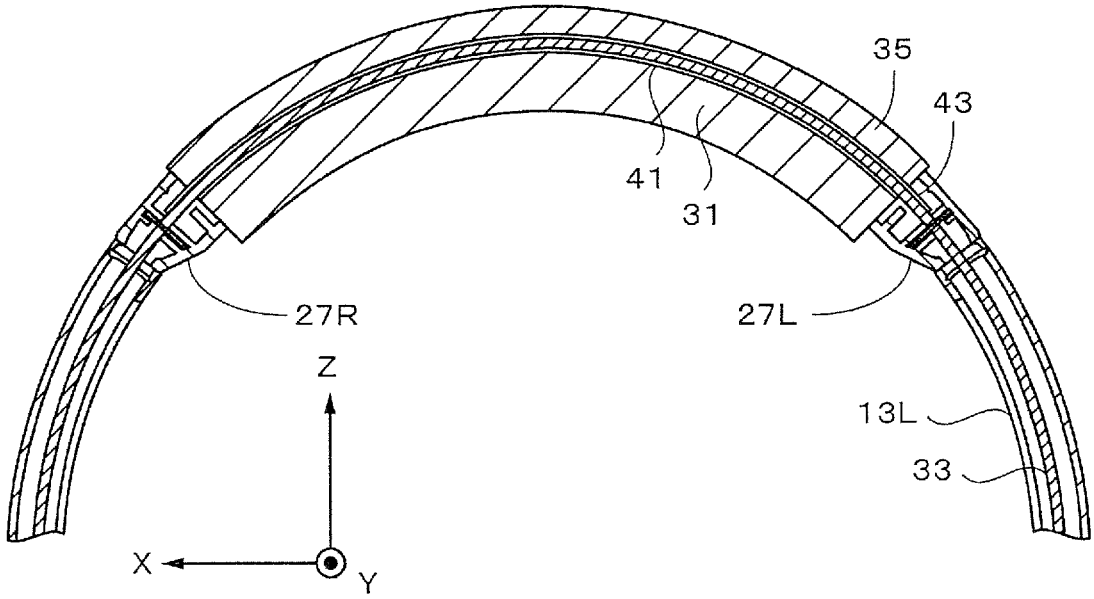
Figure 6:
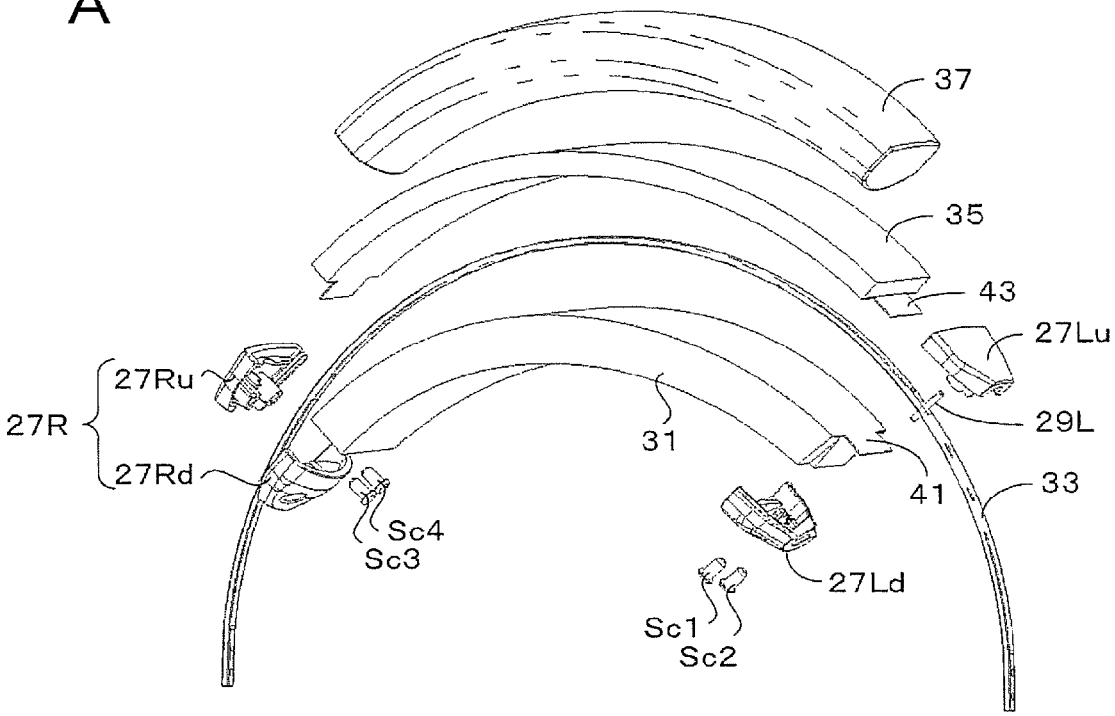
FIG. 6A is an exploded perspective view illustrating the first modified example of the pad portion of the headphone apparatus of the present disclosure.
FIG. 6B is a cross-sectional view illustrating a second modified example of the pad portion of the headphone apparatus of the present disclosure.
Figure 6:
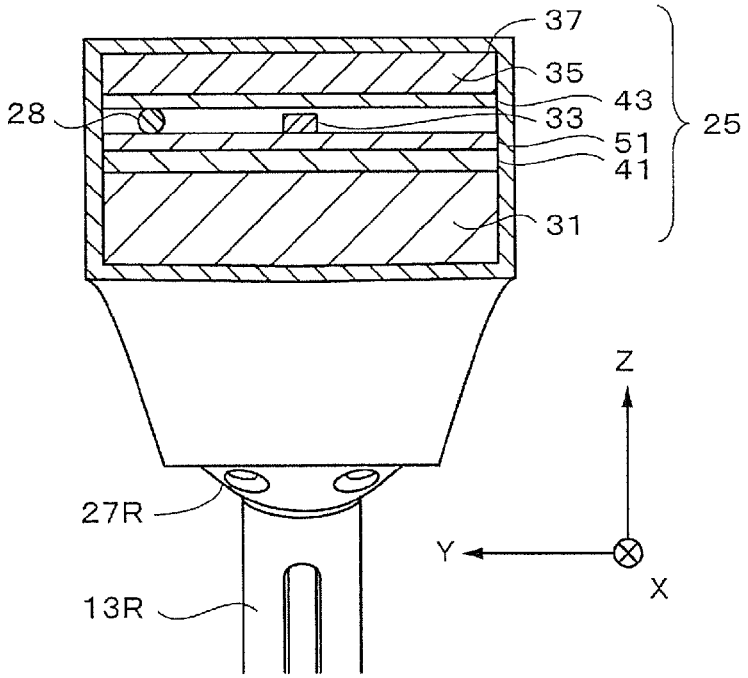

FIGS. 5A and 5B are cross-sectional views illustrating a first modified example of the pad portion of the headphone apparatus of the present disclosure. FIG. 6A is an exploded perspective view illustrating the first modified example of the pad portion of the headphone apparatus of the present disclosure. FIG. 5A is a schematic view illustrating an example of a cross-section of the pad portion when cut along a plane (Σ1 of FIG. 2A) perpendicular to a direction connecting the right and left headphone units. FIG. 5B is a schematic view illustrating an example of a cross-section of the head band when cut along a plane (Σ2 of FIG. 2A) including a direction connecting the right and left headphone units and including a vertical direction. In FIG. 5B, the covering material 37 is not shown.

The pad portion 23 illustrated in FIG. 5A is equivalent to the pad portion 21 of the above-described embodiment as including the lower cushion material 31, the core material 33, the upper cushion material 35, and the covering material 37. The pad portion 23 illustrated in FIGS. 5A and 5B differs from the pad portion 21 of the above-described embodiment in that a supporting plate 41 shaped like an arc is further included between the lower cushion material 31 and the core material 33. FIGS. 5A and 5B illustrate examples of the pad portion 23 that further includes a supporting plate 43 shaped like an arc between the core material 33 and the upper cushion material 35.

As illustrated in FIGS. 5A and 5B, and FIG. 6A, in the pad portion 23, there is a stacked structure including, for example, the lower cushion material 31, the supporting plate 41, the core material 33, the supporting plate 43, and the upper cushion material 35. The stacked body including the lower cushion material 31, the supporting plate 41, the core material 33, the supporting plate 43, and the upper cushion material 35 is covered with the covering material 37. Both ends of the covering material 37 are fixed, for example, by the end covers 27L and 27R, respectively. The end cover 27R is formed like the end cover 27L and includes upper and lower cover bodies 27Ru and 27Rd made of, for example, a resin material. The upper and lower cover bodies 27Ru and 27Rd are joined together by screws Sc3 and Sc4.

(1-2-1. Supporting Plate)

The supporting plate 41 is formed to have substantially the same width as the lower cushion material 31 and arranged inside the pad portion 23 along the core material 33. The supporting plate 41 may be extended, for example, to the inside of the end covers 27L and 27R.

The supporting plate 41 is formed by a hard material compared to the lower cushion material 31. A material used to form the supporting plate 41 may include, for example, a resin material, a metal, ceramics, and a plant material. Examples of the resin material may include polyethylene terephthalate (PET), polybutylene terephthalate (PBT), polycarbonate (PC), polyamide (PA), polyacetal (POM), polyphenylene sulfide (PPS), polyethylene (PE), polypropylene (PP), polystyrene (PS), an acrylonitrile-butadiene-styrene (ABS) resin, a methacrylic resin (acrylic-based resin), polyvinyl chloride (PVC), a phenol resin, a melamine resin, an epoxy resin, and polyimide. The supporting plate 41 may be formed by a composite material, such as a carbon fiber reinforced plastic or a glass fiber reinforced plastic.

The supporting plate 41 has a function to keep the shape of the lower cushion material 31. By arranging the supporting plate 41, which is harder than the lower cushion material 31, between the core material 33 and the lower cushion material 31, the load from the core material 33 can be uniformly transmitted to the lower cushion material 31. Accordingly, stableness of the headphone apparatus can be improved in wearing the headphone.

As illustrated in FIGS. 5A and 5B, and FIG. 6A, the supporting plate 43 may be arranged on the side opposite to the contact surface with the head of the user relative to the core material 33. That is, the supporting plate may additionally be arranged between the core material 33 and the cushion material 35. In this case, the pad portion may not include the upper cushion material 35.

By forming the pad by the combination of a highly rigid member and a soft material, while arranging the soft material on the side where the head of the user is in contact with, the weight of the headphone can be uniformly distributed over the top of the head of the user. Accordingly, a large force is not applied only to a part of the head of the user, alleviating uncomfortable feelings in wearing the headphone.

Since the soft material is arranged on the side of the contact area against the head of the user, the contact area between the pad and the head of the user can follow not only the tilting but also other shapes of the head of the user. Accordingly, the uncomfortable feelings in wearing the headphone can be prevented.

1-3. Second Modified Example

FIG. 6B is a cross-sectional view illustrating a second modified example of the pad portion of the headphone apparatus of the present disclosure. FIG. 6B is a schematic view illustrating an example of a cross-section of the pad portion when cut along a plane (Σ1 in FIG. 2A) perpendicular to a direction connecting the right and left headphone units.

The pad portion 25 illustrated in FIG. 6B is similar to the pad portion 21 of the embodiment described above as including the lower cushion material 31, the core material 33, the upper cushion material 35, and the covering material 37. The pad portion 25 illustrated in FIG. 6B is also similar to that of the first modified example described above as including, inside the pad portion 25, a stacked structure of, for example, the lower cushion material 31, the supporting plate 41, the core material 33, the supporting plate 43, and the upper cushion material 35. Meanwhile, the pad portion 25 illustrated in FIG. 6B differs from the pad portion 21 and the pad portion 23 described above in that a low friction material 51 is additionally arranged between the lower cushion material 31 and the core material 33.

As illustrated in FIG. 6B, the pad portion 25 includes a stacked structure in which, for example, the lower cushion material 31, the supporting plate 41, the low friction material 51, the core material 33, the supporting plate 43, and the upper cushion material 35 are stacked on top of each other. The stacked body including the lower cushion material 31, the supporting plate 41, the low friction material 51, the core material 33, the supporting plate 43, and the upper cushion material 35 is covered with the covering material 37. Both ends of the covering material 37 are fixed, for example, by the end covers 27L and 27R, respectively.

(1-3-1. Low Friction Material)

The low friction material 51 is formed to have at least a width equal to a width of the portion where the core material 33 and the lower cushion material 31 are in contact with each other. For example, the low friction material 51 may be attached to the surface of the lower cushion material 31 or the supporting plate 41 along the core material 33. Alternatively, the low friction material 51 may cover the outer side of the core material 33.

The low friction material 51 is interposed between the core material 33 and the lower cushion material 31 to reduce frictional force therebetween. Accordingly, the lower cushion material 31 can easily rotate relative to the core material 33. Therefore, as the low friction material 51, a material having a reduced rolling friction coefficient, compared to the case where the core material 33 is in direct contact with the lower cushion material 31, between the core material 33 and the lower cushion material 31 would be selected.

For example, the low friction material 51 is made of cloth, and is preferably made of fabric such as felt, velvet, satin cloth, organdy cloth, and woven cloth called georgette. Alternatively, the low friction material 51 may be formed as a supporting plate with a fluororesin layer formed thereon. By providing the protrusion/recess shape on the surface of the lower cushion material 31 and the supporting plate 41, it may be possible to decrease the contact area between the core material 33 and the lower cushion material 31 to thereby reduce the friction force therebetween.

By arranging the low friction material 51 at the contact surface between the core material 33 and the lower cushion material 31, the lower cushion material 31 can rotate more smoothly relative to the core material 33 to follow the shape of a head more easily.

As described above, in the present disclosure, the contact surface between the core material 33 and the lower cushion material 31 is not fixed, and the pad 11 is made rotatable relative to the core material 33. That is, unlike the structure of the headphone in the related art in which the cushion material is constantly in contact with the core material vertically, the lower cushion material 31 of the present disclosure rotates about the core material 33 while being constantly in contact with the core material 33. In the present disclosure, therefore, it is possible to uniformly transmit the load applied to the core material 33 over the lower cushion material 31.

In the present disclosure, as illustrated in FIG. 1B, the pad 11 follows the tilting of the head at the top of the head of the user wearing the headphone 1 and rotates in the tilting direction. Accordingly, the contact area between the pad 11 and the head of the user is increased, which allows the uniform contact of the entire surface of the pad portion with the top of the head of the user to more uniformly transmit the weight of the headphone 1 over the top of the head. In the present disclosure, therefore, the weight of the headphone apparatus 1 can be supported uniformly over the top of the head of the user.

For example, in the case of a so-called free-adjusting structure where a pad is provided independently from a core material and supported by the force of rubber or a spring, the weight of the headphone cannot uniformly be transmitted on the pad, and a large force may be applied to a portion of the head of the user. Meanwhile, in the present disclosure, the pad is movable with both ears and the head of the user being fixed to prevent application of a large force to a portion of the head of the user. Accordingly, improved stableness in wearing the headphone apparatus and more comfortable feelings in wearing the headphone can be realized.

2. Modified Example

Although the preferred embodiments have been described above, preferred specific examples are not limited to the above description and various other modifications can be conceived.

For example, in the above description of the embodiments, the pad portion is formed by the stacked body including the lower cushion material, the core material, and the upper cushion material. Alternatively, the lower and upper cushion materials may be formed integrally with the core material penetrating therethrough. That is, a hole, for example, may be formed in the center part of the cross-section of the pad to allow the core material to pass through the hole.

In this case, the range of the rotatable angle of the pad relative to the core material can be limited by the shape of the cross-sections of the core material and the hole in the pad portion. Alternatively, the range of the rotatable angle of the pad relative to the core material can also be limited by the shape of the cross-sections of the core material and the hole in the end cover.

For example, the present disclosure is applicable to a noise canceling type headphone, a headphone for monitoring in studios, a headset for video games, earmuffs for noise countermeasure used in shooting or at a construction site, etc. The technique of the present disclosure is applicable to both open-type and closed-type headphones.

It is noted that the structures, methods, shapes, materials, numerical values, etc. listed in the above-described embodiments, are merely examples, and different structures, methods, shapes, materials, numerical values, etc. may be used as needed. The structures, methods, shapes, materials, numerical values, etc. described above may be combined in any way without departing from the scope of the present disclosure.

For example, the present disclosure may be implemented by the following structures.

(1)

A headphone apparatus including a pair of acoustic reproduction units, a supporting member connecting the pair of acoustic reproduction units, and a soft member configured to be rotatable relative to the supporting member and arranged on the side opposite to the head of a person wearing the headphone.

(2)

The headphone apparatus according to (1), further including a hard member, wherein the hard member is arranged along the supporting member.

(3)

The headphone apparatus according to (2), wherein the hard member is arranged between the supporting member and the soft member.

(4)

The headphone apparatus according to (1) or (2), further including a low friction material, wherein the low friction material is arranged between the supporting member and the soft member.

(5)

The headphone apparatus according to any one of (1) to (4), wherein a rotation angle of the soft member relative to the supporting member is set within a predetermined fixed range.

REFERENCE SIGNS LIST

1 HEADPHONE APPARATUS 3 HEAD BAND
5L, 5R HEADPHONE UNIT
11 PAD
21, 23, 25 PAD PORTION
27L, 27R END COVER
29L PIN
31 LOWER CUSHION MATERIAL
33 CORE MATERIAL
41, 43 SUPPORTING PLATE
51 LOW FRICTION MATERIAL

The invention claimed is:

1. A headphone apparatus, comprising:

a pair of acoustic reproduction units; and an arcuate-shaped supporting member connecting the pair of acoustic reproduction units and configured to extend across a user's head substantially from ear-to-ear, the supporting member including a pad portion configured to be disposed generally on top of and in contact with the user's head, the pad portion including a band-shaped core material extending thereacross and a soft member in a form of a lower cushion material extending thereacross and configured to be disposed between the user's head and the band-shaped core material, wherein, as the head of the user moves from a normal posture position into a forwardly and downwardly direction or a backwardly and upwardly direction, the soft member moves forwardly or backwardly relative to the band-shaped core material while the band-shaped core material remains in a stationary state.

2. The headphone apparatus, according to claim 1, further comprising a hard member, wherein the hard member is arranged along the supporting member.

3. The headphone apparatus, according to claim 2, wherein the hard member is arranged between the supporting member and the soft member.

4. The headphone apparatus, according to claim 1, further comprising a low friction material, wherein the low friction material is arranged between the supporting member and the soft member.

5. The headphone apparatus, according to claim 1, wherein a rotation angle of the soft member relative to the supporting member is set within a predetermined fixed range.

6. A headphone apparatus, comprising:

a pair of acoustic reproduction units; and an arcuate-shaped supporting member connecting the pair of acoustic reproduction units and configured to extend across a user's head substantially from ear-to-ear, the supporting member including a pad portion configured to be disposed generally on top of and in contact with the user's head, the pad portion including a band-shaped core material extending thereacross and a soft member in a form of a lower cushion material extending thereacross and configured to be disposed between the user's head and the band-shaped core material, wherein, as the head of the user moves from a normal posture position into a forwardly and downwardly direction or a backwardly and upwardly direction, the soft member moves forwardly or backwardly relative to the band-shaped core material thereby reducing pressure from the pad portion on top of the user's head as the user's head moves from the normal posture position into the forwardly and downwardly direction or the backwardly and upwardly direction.

* * * * *